US005547145A

United States Patent [19]

Pagano et al.

[11] Patent Number: 5,547,145

[45] Date of Patent: Aug. 20, 1996

[54] AUTOMATIC PROCESSING REEL FOR USE IN PHOTOFINISHING

[75] Inventors: Daniel M. Pagano, Henrietta; Kevin J. Klees, Rochester, both of N.Y.

[73] Assignee: Eastman Kodak Company, Rochester, N.Y.

[21] Appl. No.: 330,400

[22] Filed: Oct. 27, 1994

[51] Int. Cl.[6] ..... B65H 18/08

[52] U.S. Cl. ..... 242/536

[58] Field of Search ..... 242/348, 348.3, 242/536, 602, 602.3

[56] References Cited

U.S. PATENT DOCUMENTS

| | | | |
|---|---|---|---|
| 2,594,980 | 4/1952 | Neuwirth | 242/536 |
| 2,595,898 | 5/1952 | Siedenburg | 242/602.3 |
| 2,710,727 | 6/1955 | Orowick | 242/602.3 |
| 2,711,864 | 6/1955 | Windman | 242/602.3 |
| 2,756,005 | 7/1956 | Franke | 242/536 |
| 4,448,365 | 5/1984 | Petsching et al. | 242/602.3 |
| 5,445,336 | 8/1995 | Pagano | 242/348.3 |

*Primary Examiner*—John P. Darling
*Attorney, Agent, or Firm*—Frank Pincelli

[57] ABSTRACT

An apparatus for automatically advancing or removing a filmstrip from a reel and a reel for holding a photosensitive filmstrip during photofinishing. The reel includes a first side wall and a second side wall substantially parallel to the first side wall. The first and second side walls each having a wall member disposed in a spiral pattern so as to form a spiral path for receiving the edges of a photosensitive filmstrip between said side walls. A clutch mechanism is provided on each side wall for advancing the filmstrip along the spiral path in a first direction and preventing movement in the opposite direction. A spring member is provided for disengaging the clutch mechanism so as to allow removal of the filmstrip from the spiral path. The clutch mechanism may include a movable ramp for allowing movement of the photosensitive material in either direction along the spiral path.

22 Claims, 5 Drawing Sheets

AUTOMATIC PROCESSING REEL FOR USE IN PHOTOFINISHING

FIELD OF THE INVENTION

The present invention is directed to a processing reel for use in photofinishing and more particular to a processing reel able to automatically load and unload the film thereon.

BACKGROUND OF THE INVENTION

In the prior art there exists processing reels for manually processing film, such as the Patterson super system 4-reel sold by Patterson Products. The film reel includes a right and left sides, each side having a projecting wall that is formed in a spiral pattern. The sides are positioned with respect to each other such that the projecting wall on each side face and are aligned such that a spiral path is formed between the two sides for receiving the edges of a strip of photosensitive material for photofinishing. The reel is designed such that an oscillating rotation motion may be provided between the two sides. Typically, the oscillating motion between the sides is approximately 30°. In each of the sides adjacent the entrance to the spiral path, a ball clutch is provided for feeding the film to be fed into the spiral path in response to oscillating one side with respect to the other. However, a disadvantage of such reel is that the film must be manually removed from the reel. An other disadvantage of such reels is that they are designed to be manually oscillated for feeding of the photosensitive material.

Applicants have invented a improved photo processing reel wherein the film may be automatically put on and removed from the processing reel.

SUMMARY OF THE INVENTION

In one aspect of the present invention there is provided a reel for holding a photosensitive filmstrip. The reel includes a first side wall and a second side wall substantially parallel to the first side wall. The first and second side walls each having a wall member disposed in a spiral pattern so as to form a spiral path for receiving the edges of a photosensitive filmstrip between said side walls. A clutch mechanism is provided on each side wall for advancing the filmstrip along the spiral path in a first direction and preventing movement in the opposite direction. A spring member is provided for disengaging the clutch mechanism so as to allow removal of the filmstrip from the spiral path.

In another aspect of the present invention there is provided a reel for holding a photosensitive filmstrip having a first side wall and a second side wall substantially parallel to the first side wall. The first and second side walls each having a wall member disposed in a spiral pattern so as to form a spiral path for receiving the edges of a photosensitive filmstrip between the side walls. A clutch mechanism is provided which can be set for advancing or removing the filmstrip along the spiral path.

In yet another aspect of the present invention there is provided an apparatus for automatically feeding on to and/or removing a filmstrip from a reel. The reel comprises a first side wall and a second side wall substantially parallel to the first side wall. The first and second side walls each having a wall member disposed in a spiral pattern so as to form a spiral path for receiving the edges of a photosensitive filmstrip between the side walls. A clutch mechanism is provided for advancing the filmstrip along the spiral path. The first side wall is stationary mounted to the apparatus. A shaft is secured to the second side wall and is connected to a drive means for oscillating said second side wall so as to move said filmstrip along said spiral path.

DETAILED DESCRIPTION

Figure 2:
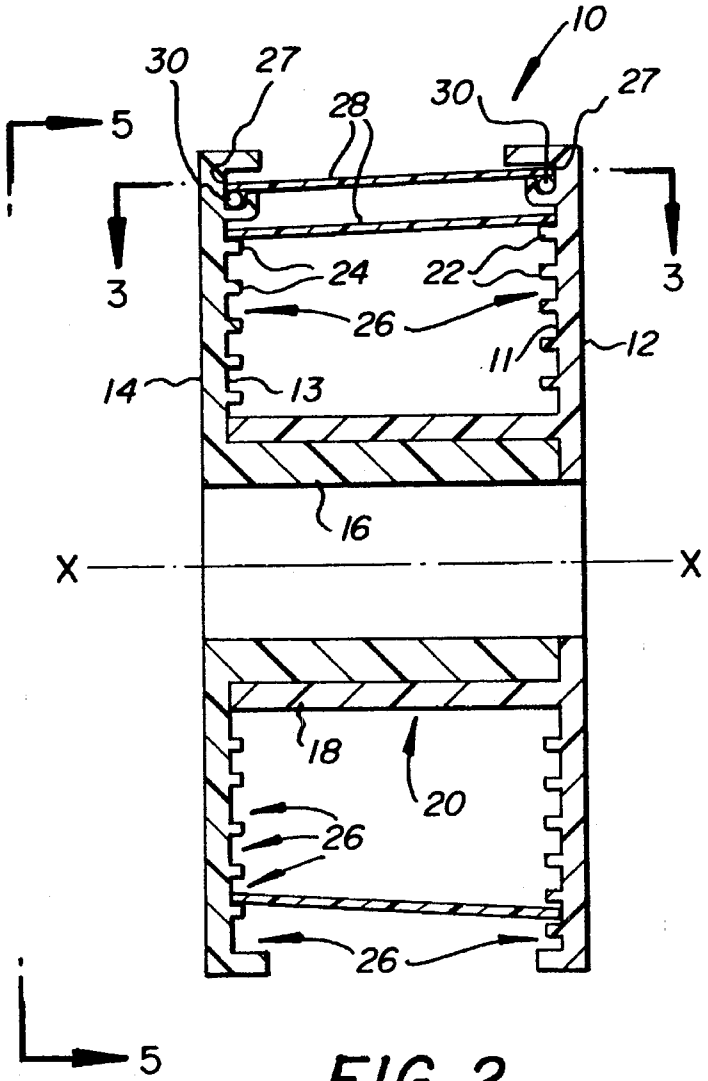
FIG. 2 is a cross-sectional view of the reel of FIG. 1 as taken along line 2—2 of FIG. 1.
Figure 1:
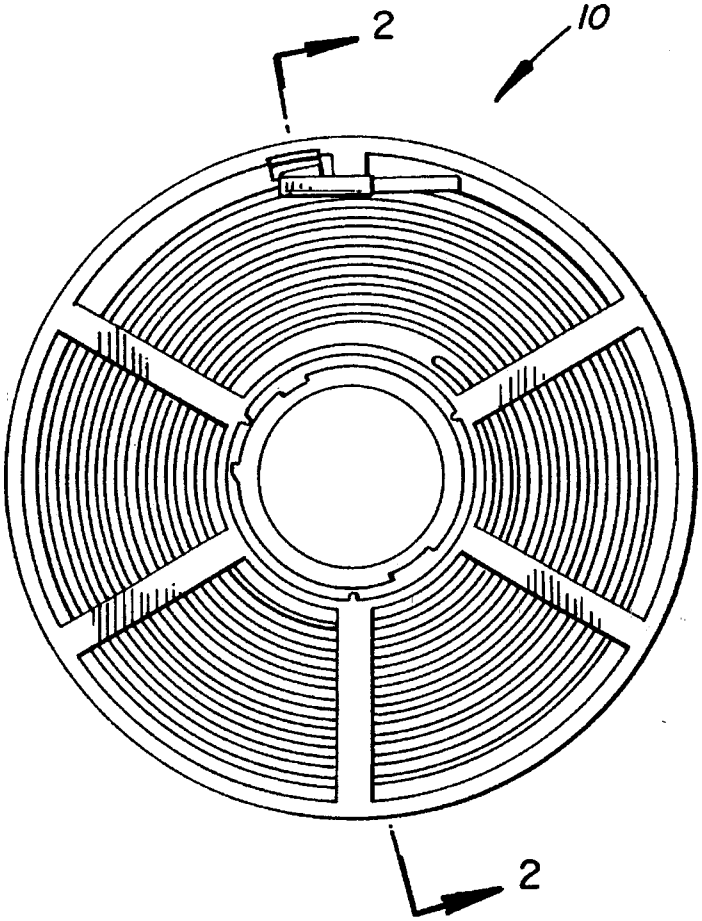
Referring to FIG. 1 there is illustrated a side elevational view of a processing reel made in accordance with the present invention.

Referring to FIGS. 1–5, there is illustrated a processing reel 10 made in accordance with the present invention. The processing reel 10 includes a pair of substantially parallel side walls 12,14. Side wall 14 has an annular inner projection 16 which extends therefrom and mates with an annular outer projection 18 extending from side wall 12 so as to form a central hub in reel 10. The inner surfaces 11,13 of the sides of walls 12,14 facing each other are each provided with a projecting wall member 22,24, respectively. The members 22,24 on each respective side wall is provided in a substantially spiral pattern about hub 20 and are aligned with respect to each other so as to form a spiral path 26 for receiving the side edges 27 of a photosensitive material such as a filmstrip 28, as illustrated in FIG. 2. The walls 12,14, through annular portions 16,18, are mounted to each other such that a rotating reciprocating motion about axis x-x is provided between walls 12,14. In the particular embodiment illustrated, the side wall 14 is allowed to oscillate back and forth approximately 30° with respect to side wall 12.

Figure 3:
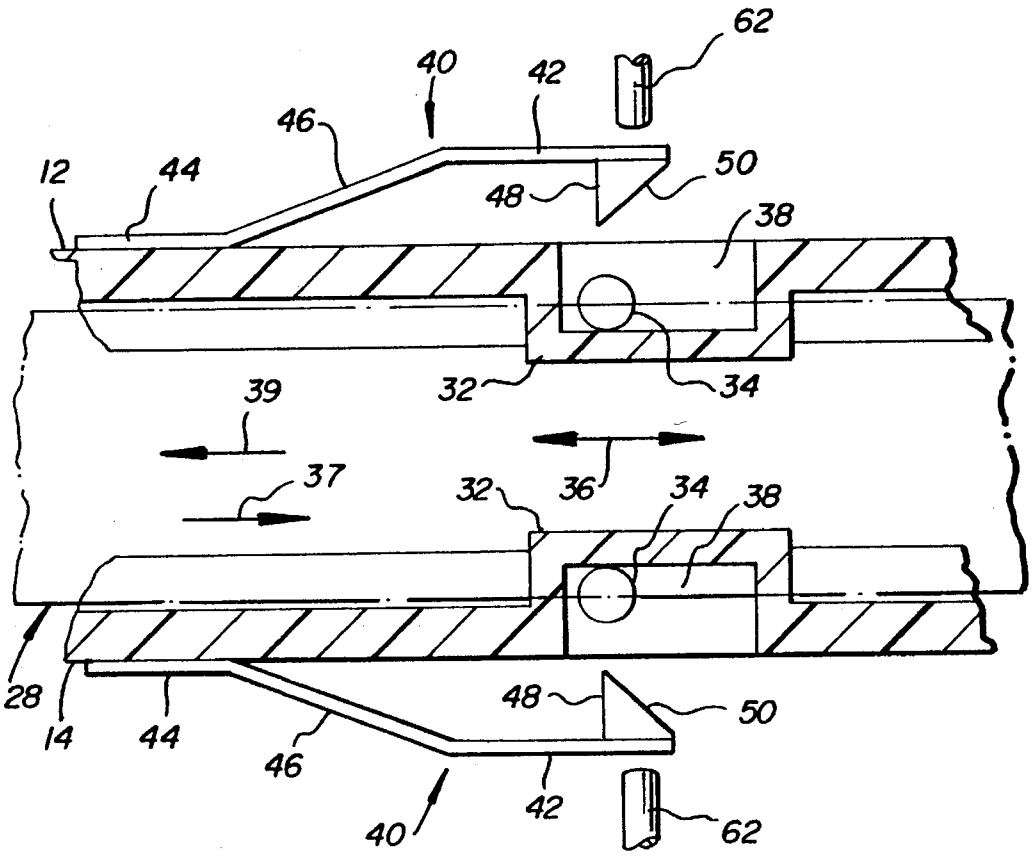
FIG. 3 is a cross-sectional view of the reel as taken along line 3—3 of FIG. 2 illustrating the clutch disengagement mechanism in the unengaged position.
Figure 5:
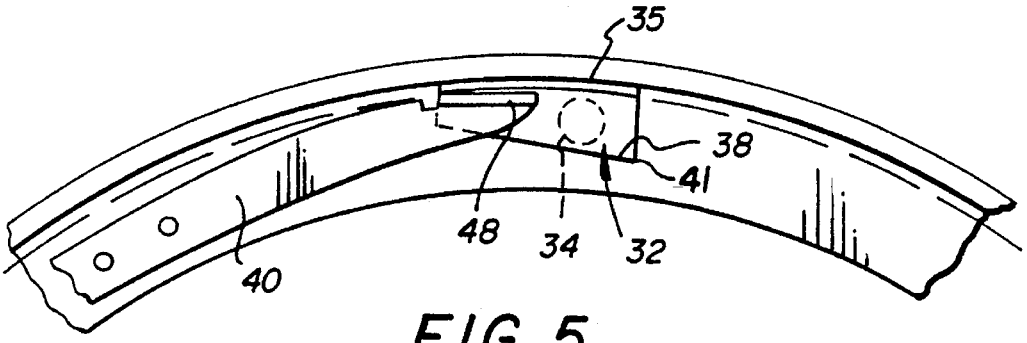
FIG. 5 is a side elevational view as taken along line 5—5 of FIG. 2.

Referring to FIG. 3, each of the side walls 12,14 are provided with a clutch mechanism 30 such that when the side walls are reciprocated in one direction relative to each other, film will be advanced through spiral path 26, and when oscillated in the opposite circumferential direction will prevent movement of the photosensitive material out of path 26. In particular, the clutch mechanism includes a cage 32 designed to receive a spherical member/ball 34. In the particular embodiment illustrated, spherical member 34 is a steel ball. The cage 32 is configured and sized such that the ball 34 is trapped within cage 32 and can be moved only along the circumferential direction as illustrated in FIG. 3 by arrow 36. The clutch mechanism includes a ramp surface 38 within cage 32. The ramp surface 38 is designed such that when the photosensitive material is moved in the direction indicated by arrow 39, the film will be caught between the top surface of the ball 34 and outer wall 35 causing it to be moved in a direction in which the wall member is being oscillated, and when one wall member is moved in the opposite direction with respect to the other side, as indicated by arrow 37, the ball member 34 will be at the lower end 41 of ramp 38, as illustrated in FIG. 5 by solid lines, thus allowing movement of one the side walls 12,14 without moving the film. If the film is pulled in a direction to remove the film from the spiral path 26, as indicated by arrow 39, the balls in each of the cages will prevent the filmstrip 28 from being pulled out.

In order to allow the filmstrip to be moved in the direction indicated by arrow 39 so as to remove the filmstrip 28 from the spiral path 26, clutch disengaging means is provided for disengaging of the ball 34 from the filmstrip when it is moved in the direction indicated by arrow 37. In the embodiment illustrated, there is provided a pair of spring members 40, one associated with each of-the cages 32 having a forward engaging portion 42 and a rear end 44 which is secured to the associated wall member 14. It is to be understood that the rear end 44 may be secured in any desired manner, for example, means such as screws, adhesive, rivets, etc. Each spring member 40 has a central portion 46 which extends in a direction outwardly from adjacent wall member 12,14 and terminates in forward end 42. Forward end 42 is provided with a projecting portion 48 which has an engaging surface 50 which can pass through an access opening provided in cage 32. The surface 50 is configured so as to engage the spherical member 34 and thereby force the spherical ball member 34 to be retained at the lower end portion 41 of the ramp surface 38 so that the film will not engage ball 34 as it is moved in the removal direction. A biasing mechanism is provided for engaging and disengaging surface 50 with ball 34. In the embodiment illustrated, biasing mechanism comprises a projecting member 62 which is associated with an appropriate solenoid (not shown) which can be energized as required thereby moving projection 48 such that the engaging surface 50 may be moved to the position illustrated in FIG. 4, thus keeping the spherical ball 34 in the disengaged position with respect to the film within the spiral path 26 thereby allowing the film to be pulled out of the reel 10 in the direction indicated by arrow 39.

Figure 4:
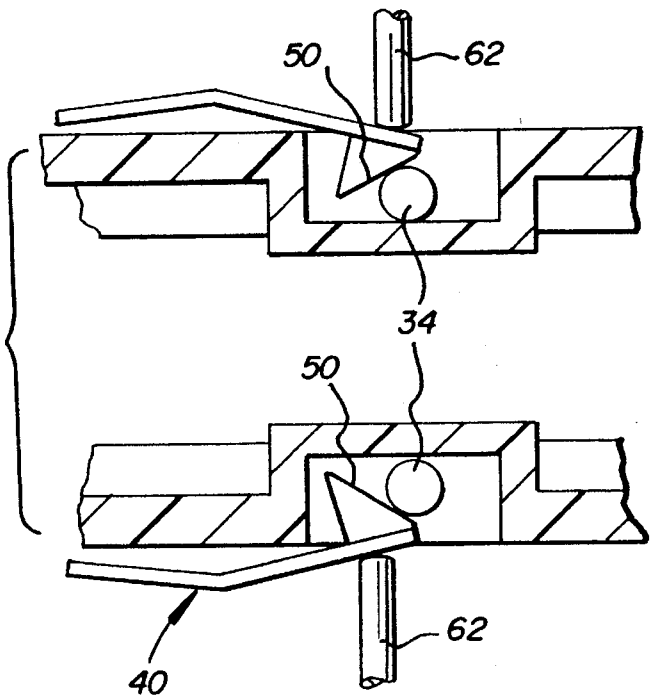
FIG. 4 is a view similar to FIG. 3 illustrating the clutch disengaging mechanism in the engaged position.
Figure 6:
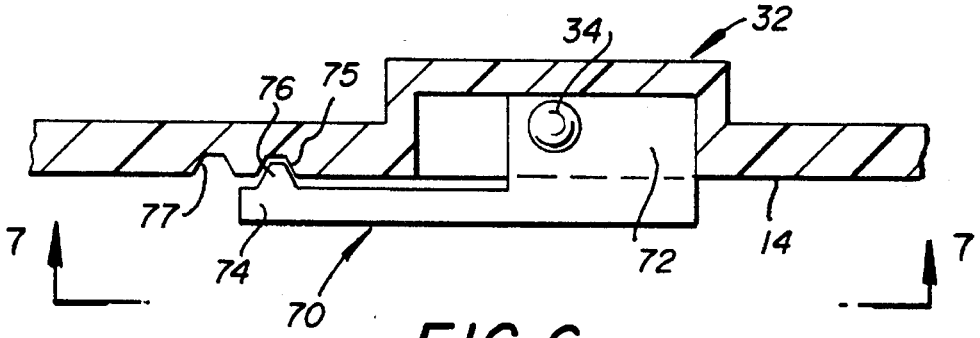
FIG. 6 is an enlarged partial cross-sectional view of a reel similar to FIG. 3 illustrated a modified disengaging clutch mechanism.
Figure 7:
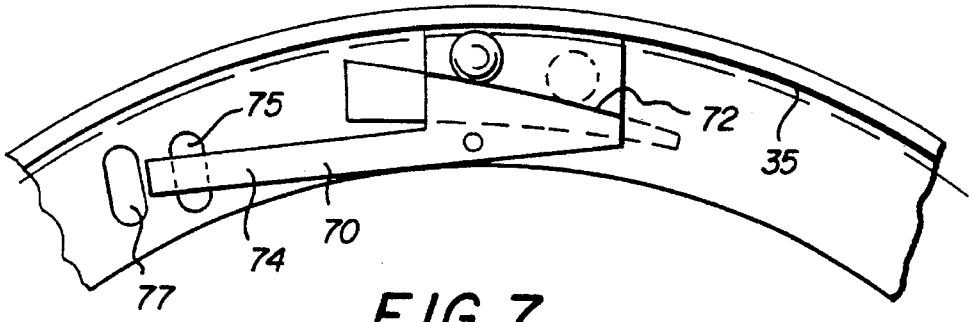
FIG. 7 is a side elevational view of FIG. 6 as taken along line 7—7 illustrating the clutch disengaging mechanism in the unengaged position.
Figure 8:
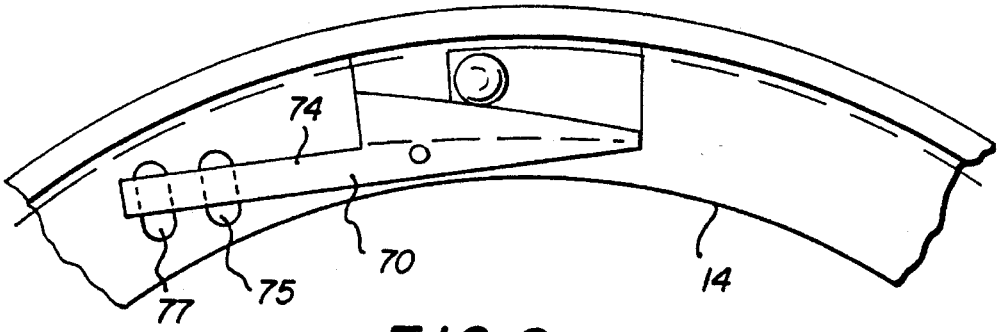
FIG. 8 is a side elevational view similar to FIG. 7 illustrating the clutch mechanism in the disengaged position.

Referring to FIGS. 6, 7 and 8, there is illustrated a modified clutch disengagement means for use in a reel made in accordance with the present invention. FIG. 6 is a view similar to FIGS. 3 and 4, and FIG. 7 is similar to the view of FIG. 5, like numbers indicating like parts. FIGS. 6–8 illustrate the clutch disengaged means as being associated with wall member 14, it is to be understood that an identical-type member is associated with wall member 12 (not shown). The difference in this embodiment is that instead of having spring member 40, there is provided a slide member 70 which is moveable between a first position illustrated in FIGS. 6 and 7 and a second position illustrated in FIG. 8. Slide member 70 has a surface 72 which takes the place of ramp surface 38 previously discussed with respect to the embodiment illustrated in FIGS. 1–5. When slide member 70 is moved into the disengaged position illustrated in FIG. 8, the top of the ball 34 is at a lower level than it is in the normal active state as illustrated in FIGS. 6 and 7. Thus, when the slide member 70 is in the disengaged position as illustrated in FIG. 8, the film may simply slide easily between the ball and the outer wall 35. The rear end 74 of slide member 70 is flexible as to allow detent member 76 to move between recesses 75,77 in the wall member 14. It is, of course, to be understood that slide member 70 may be mounted to the wall member in any desired fashion such that it will move between the two positions.

Figure 9:
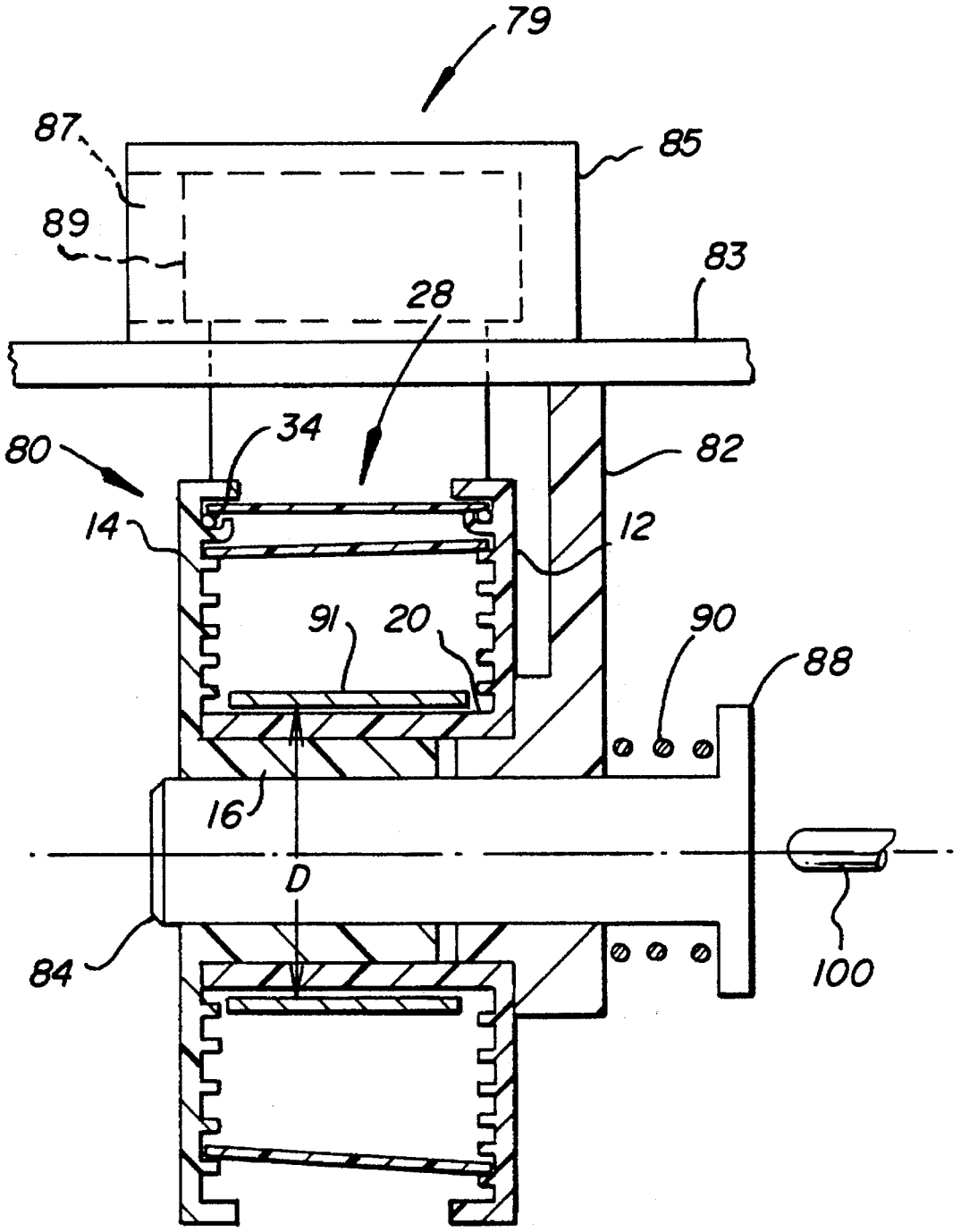
FIG. 9 is a cross-sectional view similar to FIG. 2 illustrating yet another modified reel made in accordance with the present invention.
Figure 10:
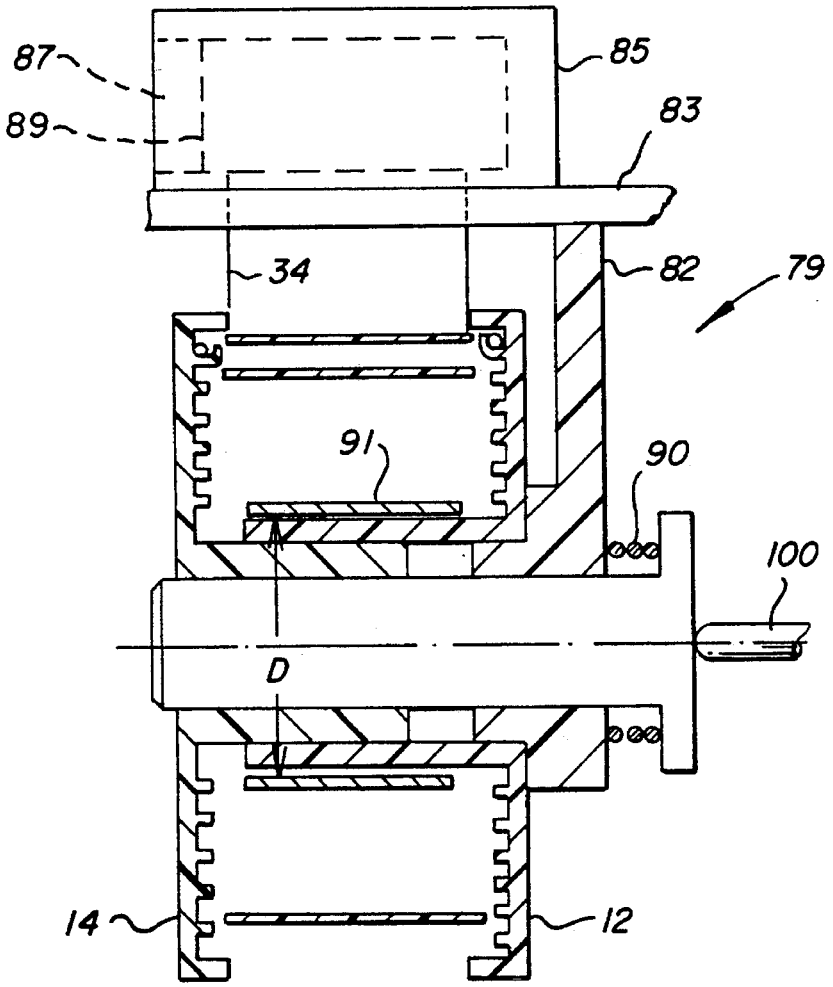
FIG. 10 is side elevational view of the reel of FIG. 9 illustrating the reel in a disengaged position.

Referring to FIGS. 9 and 10, there is illustrated a partial cross-sectional view of apparatus 79 for automatically feeding and/or removing a filmstrip from reel 80 made in accordance with the present invention. The reel 80 is similar to reel 10, like numerals indicated like parts. In this embodiment, wall member 12 is fixed to a reel support member 82 secured to apparatus 79 such that the annular outer projection 18 does not rotate, whereas wall member 14 is designed to rotate about shaft 84 to which it is secured. In particular, annular inner projection 16 is secured directly to shaft 84, which is part of apparatus 79. The shaft 84 has a flange 88 at its axially inner end, which captures a spring 90 between the flange and adjacent support member 82. The support member 82 is secured to a cover plate 83 having a retaining member 85 having a pocket 87 for receiving a film cartridge 89, preferably a thrust film cartridge cable of thrusting the filmstrip out of the cartridge and rewinding the filmstrip back into the cartridge 89. The shaft 84 can be oscillated so as to provide the oscillation motion between the side walls 12,14. An annular sleeve 91 is provided about hub 20. Sleeve 91 has an inside diameter D such that it can freely rotate about hub 20. The freely rotating sleeve 91 prevents the filmstrip 28 from cinching about hub 20 as it is being rewound back into the cartridge. When it is desired to disengage the clutch means, a projecting member 100 is moved into contact with the flange 88 so as to cause the two walls 12,14 to be separated from each other, as illustrated in FIG. 10, thereby releasing the edges of the film 28 from the clutch means. The filmstrip 28 is then rewound back into the cartridge, the film 28 being easily withdrawn from the reel 80. After the film has been removed, the projecting member 100 is disengaged from the flange 88, allowing the reel 80 to return to its position as illustrated in FIG. 9 and thereby being in position for receiving another filmstrip. It is to be understood that projecting member 100 may be moved by any desired means, for example, a solenoid (not shown). In this embodiment, the side walls can be moved to release the filmstrip. However, disengaging means, such as previously discussed with respect to FIG. 1–8 can be used to disengage the clutch mechanism and can be used in addition or in place of moving the side wall. This apparatus can be useful in automatically processing a photosensitive material, such as described in commonly assigned U.S. Ser. No. 08/330,271, filed Oct. 27, 1994, entitled METHOD AND APPARATUS FOR PROCESSING PHOTOSENSITIVE FILM, by Daniel M. Pagano, Richard B. Wheeler and Kevin J. Klees, and which is incorporated by reference.

Figure 11:
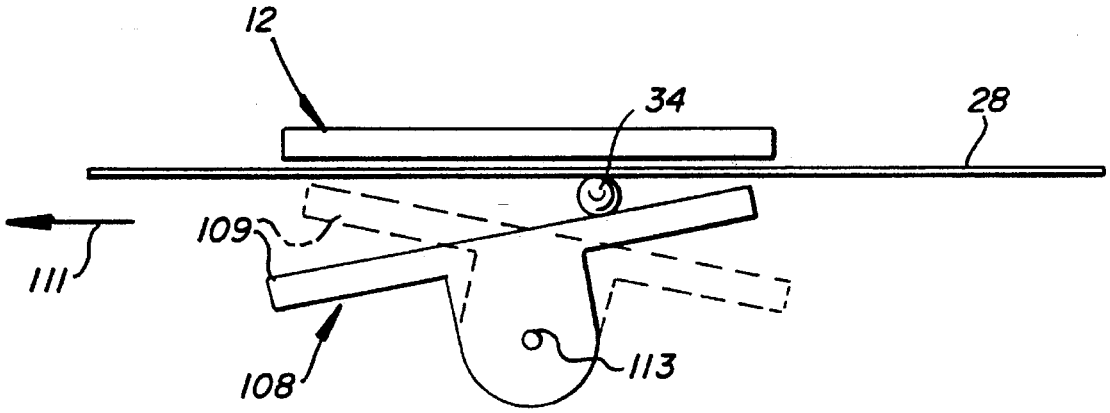
FIG. 11 is an enlarged view of an alternate clutch disengaging mechanism made in accordance with the present invention.

Referring to FIG. 11, there is illustrated another clutch/disengaging means that may be used for releasing the clutch that may be used in a reel made according to the present invention. In particular, there is illustrated a pivoting ramp member 108 designed to be pivoted between a first and second position as illustrated by solid lines and dash lines. The ramp member 108 has an upper surface 109 which defines ramp surface 38. When the ramp member 108 is in the position illustrated by solid lines, film may be inserted (loaded) into reel 10 as indicated by arrow 111 by oscillating one of the side walls 12,14 in a manner as previously discussed. When it is desired to remove (unload) the filmstrip, the ramp member 10 is rotated to the position illustrated by dash lines, thereby allowing the film to be removed by oscillating walls 12,14 in the opposite direction. A suitable mechanism for moving ramp member 108 between the two positions could be some type of rotational solenoid attached to the pivot point 113 of the ramp member 108. Thus the clutch mechanism can be set to assist in loading or unloading the filmstrip 28.

It is to be understood that various other changes and modifications may be made without departing from the scope of the present invention. The present invention being defined by the following claims.

PARTS LIST

10 . . . processing reel
12,14 . . . side walls
11,13 . . . inner surfaces
16 . . . inner projection
18 . . . outer projection
20 . . . hub
22,24 . . . projecting wall members
26 . . . spiral path
27 . . . side edges
28 . . . filmstrip
30 . . . clutch mechanism
32 . . . cage
34 . . . spherical member/ball
35 . . . outer wall
36,37,39 . . . arrow
38 . . . ramp surface
40 . . . spring members
41 . . . lower end
42 . . . forward engaging portion
44 . . . rear end
46 . . . central portion
48 . . . projecting portion
50 . . . engaging surface
62 . . . projecting member
70 . . . slide member
72 . . . surface
74 . . . rear end
75,77 . . . recesses
76 . . . detent member
79 . . . apparatus
80 . . . reel
82 . . . reel support member
83 . . . cover plate
84 . . . shaft
85 . . . retaining member
88 . . . flange
87 . . . pocket
89 . . . film cartridge
90 . . . spring
91 . . . sleeve
100 . . . projecting member
108 . . . pivoting ramp member
109 . . . upper surface
111 . . . arrow

We claim:

1. A reel for holding a photosensitive filmstrip comprising:

a first side wall and a second side wall being substantially parallel to said first side wall, said first and second side walls each having a wall member disposed in a spiral pattern so as to form a spiral path for receiving the edges of a photosensitive filmstrip between said side walls;

a clutch mechanism for advancing the filmstrip along the spiral path; and means for disengaging the clutch mechanism so as to allow removal of the filmstrip from the spiral path.

2. A reel according to claim 1 wherein said means for disengaging the clutch mechanism comprises a spring member having one end secured to the reel and one end for disengaging the clutch mechanism.

3. A reel according to claim 1 wherein said clutch mechanism includes a cage associated with each of said side walls adjacent an entrance of said spiral path, a ball located in said cage, and a ramp surface within said cage for supporting of said ball within said cage such that the ball will engage a film placed in a spiral path when one of said side walls is rotated in a first direction with respect to the other side wall so as to feed the filmstrip in the spiral path and will disengage the film when rotated in the opposite direction, said clutch mechanism preventing the filmstrip from being removed from the spiral path when the film is moved in a direction opposite to feeding of the filmstrip.

4. A reel according to claim 3 wherein said clutch mechanism further comprises a spring member having one end secured to said side walls and one end projecting into said cage so as to maintain said ball member in the disengaged position.

5. A reel according to claim 4 wherein said first and second side walls are secured together in such a manner so that the first and second side walls can be moved between at least two axially spaced positions, when the side walls are in a first axial position the edges of the filmstrip are held within said spiral path and when in a second position the filmstrip is disengaged from the spiral path.

6. A reel according to claim 5 further comprising a mechanism for moving the first and second side walls from said first position to said second position.

7. A reel according to claim 1 wherein said clutch mechanism can be positioned to either assist in feeding the filmstrip in the spiral path or for removing the filmstrip from the spiral path.

8. A reel according to claim 7 wherein said clutch mechanism includes a cage associated with each of said side walls adjacent an entrance of said spiral path, a ball located in said cage, and a pivoting ramp surface within said cage for supporting of said ball within said cage such that the ball will engage a film placed in a spiral path when one of said side walls is rotated in a first direction with respect to the other side wall so as to move the filmstrip in the spiral path and will disengage the film when rotated in the opposite direction, said pivoting ramp being capable of being positioned between a loading and unloading positions such that when the ramp is in the loading position oscillating the side walls will feed the film strip into the spiral path and when in the unloading position oscillating the side walls will remove the film strip from the spiral path.

9. A reel according to claim 8 further comprising means for moving the ramp between the loading and unloading positions.

10. A reel for holding a photosensitive filmstrip comprising:

a first side wall and a second side wall being substantially parallel to said first side wall, said first and second side walls each having a wall member disposed in a spiral pattern so as to form a spiral path for receiving the edges of a photosensitive filmstrip between said side walls; and a clutch mechanism which can be set for advancing or removing the filmstrip along the spiral path.

11. A reel according to claim 10 further comprising means for disengaging the clutch mechanism so as to allow movement of the filmstrip in any direction along the spiral path.

12. A reel according to claim 10 wherein said clutch mechanism includes a cage associated with each of said side walls adjacent an entrance of said spiral path, a ball located in said cage, and a pivoting ramp surface within said cage for supporting of said ball within said cage such that the ball will engage a film placed in a spiral path when one of said side walls is rotated in a first direction with respect to the other side wall so as to move the filmstrip in the spiral path and will disengage the film when rotated in the opposite direction, said pivoting ramp being capable of being positioned between a loading and unloading positions such that when the ramp is in the loading position oscillating the side walls will advance the film strip into the spiral path and when in the unloading position oscillating the side walls will remove the film strip from the spiral path.

13. A reel according to claim 12 further comprising means for moving the ramp between the loading and unloading positions.

14. A reel according to claim 13 wherein said means for moving comprises a rotary solenoid.

15. A reel according to claim 13 wherein said means for moving comprises a stepper motor.

16. A reel for holding a photosensitive filmstrip comprising:

a first side wall and a second side wall being substantially parallel to said first side wall, said first and second side walls each having a wall member disposed in a spiral pattern so as to form a spiral path for receiving the edges of a photosensitive filmstrip between said side walls, said first and second side walls are secured together in such a manner so that the first and second side walls can be moved between at least two axially spaced positions, when the side walls are in a first axial position the edges of the filmstrip are held within said spiral path and when in a second position the filmstrip is disengaged form the spiral path;

a clutch mechanism for advancing the filmstrip along the spiral path; and means for disengaging the clutch mechanism so as to allow removal of the filmstrip from the spiral path.

17. A reel according to claim 16 where said clutch mechanism is designed such that it will engage a film placed in the spiral path when one of said side walls is rotated in a first direction with respect to the other side wall so as to move the filmstrip in the spiral path and will disengage the film when rotated in the opposite direction.

18. An apparatus for automatically feeding on to and removing a filmstrip from a reel, said reel comprising a first side wall and a second side wall being substantially parallel to said first side wall, said first and second side walls each having a wall member disposed in a spiral pattern so as to form a spiral path for receiving the edges of a photosensitive filmstrip between said side walls, and a clutch mechanism for advancing the filmstrip along the spiral path, said first side wall is stationary mounted to said apparatus a shaft secured to said second side wall, said shaft capable of being connected to a drive means for oscillating said second side wall so as to move said filmstrip along said spiral path.

19. An apparatus according to claim 18 wherein said first and second side walls are secured together in such a manner so that the first and second side walls can be moved between at least two axially spaced positions, when the side walls are in a first axial position the edges of the filmstrip are held within said spiral path and when in a second position the filmstrip is disengaged form the spiral path.

20. An apparatus according to claim 19 further comprising a mechanism for moving the first and second side walls from said first position to said second position.

21. An apparatus according to claim 18 further comprising means for disengaging the clutch mechanism.

22. An apparatus according to claim 18 wherein a rotatable sleeve is provided between said first and second side walls so as to prevent cinching of the filmstrip onto the reel.

* * * * *